US009663888B2

(12) United States Patent
Kim

(10) Patent No.: US 9,663,888 B2
(45) Date of Patent: May 30, 2017

(54) WASHING MACHINE AND WASHING METHOD THEREOF

(71) Applicant: Dongbu Daewoo Electronics Corporation, Seoul (KR)

(72) Inventor: In Dong Kim, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 125 days.

(21) Appl. No.: 14/556,722

(22) Filed: Dec. 1, 2014

(65) Prior Publication Data

US 2016/0010258 A1 Jan. 14, 2016

(30) Foreign Application Priority Data

Jul. 9, 2014 (KR) ..... 10-2014-0086049

(51) Int. Cl.

| | |
|---|---|
| ***D06F 37/30*** | (2006.01) |
| ***D06F 37/06*** | (2006.01) |
| *D06F 17/06* | (2006.01) |
| *D06F 23/02* | (2006.01) |
| *D06F 37/22* | (2006.01) |

(52) U.S. Cl.

CPC ..... *D06F 37/065* (2013.01); *D06F 37/30* (2013.01); *D06F 17/06* (2013.01); *D06F 23/02* (2013.01); *D06F 37/22* (2013.01)

(58) Field of Classification Search

None

See application file for complete search history.

(56) References Cited

U.S. PATENT DOCUMENTS

2003/0074932 A1 4/2003 No et al.

FOREIGN PATENT DOCUMENTS

| | | | |
|---|---|---|---|
| CN | 1414163 | A | 4/2003 |
| KR | 10-0534643 | B1 | 12/2005 |
| KR | 1020050114812 | A | 12/2005 |
| KR | 100627905 | B1 * | 9/2006 |
| KR | 2006-0114121 | | 11/2006 |
| KR | 100875834 | B1 | 12/2008 |

OTHER PUBLICATIONS

Dong, Jeon Gyu; Remaining Water Circulation System for a Drum Type Washing Machine; Korean Patent Abstracts, Publication No. 20060114121 A; Publication date: Nov. 6, 2006; Korean Intellectual Property Office, http://kpa.kipris.or.kr/.

Chinese Office Action dated Dec. 5, 2016 issued in corresponding Chinese Patent Application No. 201510072770.1 and English translation thereof.

* cited by examiner

*Primary Examiner* — Michael Barr
*Assistant Examiner* — Cristi Tate-Sims

(57) ABSTRACT

A washing machine includes an auxiliary washing unit. When an inner tank is rotated during a washing cycle or a rinsing cycle, laundry experiences direct impact from an impact projection member of a rotator assembly of the auxiliary washing unit, thereby improving washing performance by virtue of the rubbing caused by such impact.

16 Claims, 5 Drawing Sheets

WASHING MACHINE AND WASHING METHOD THEREOF

CROSS-REFERENCE TO RELATED APPLICATION

This application is based on and claims priority to Korean Patent Application No. 2014-0086049, filed on Jul. 9, 2014, the disclosure of which is incorporated herein in its entirety by reference.

TECHNICAL FIELD

Embodiments according to the present invention relate to washing machines with an auxiliary washing unit and washing methods thereof that improve washing performance.

BACKGROUND

A washing machine uses power from an electric motor as its main power, and performs washing, rinsing, and dehydrating (e.g., spin-drying) processes to clean laundry through the action of detergent and water. The washing machine includes an electric motor, which is a power apparatus, a mechanical part that transfers energy to the laundry, a controlling part that controls the washing process, a water supply apparatus, and a water draining apparatus.

Washing machines may be classified into agitator type washing machines, pulsator type washing machines, and drum type washing machines, depending on their washing schemes. An agitator type washing machine performs washing by horizontally rotating a wing-shaped agitator in the center of a washing tub, and the pulsator type washing machine performs washing using waves generated by rotating a disk-shaped pulsator. A drum type washing machine includes a drum having a plurality of protrusions formed thereon. The drum type washing machine performs washing using the impact generated when the laundry is lifted by a lifter in the drum and then dropped into the wash water and detergent in the drum as a result of rotating the drum around a horizontal axis.

A washing machine is for washing laundry as cleanly as possible. For this purpose, efforts to improve washing performance are ongoing.

As a part of the efforts to improve washing performance, the Applicant applied for a patent application that includes an apparatus for elating water remaining between the tub and the drum, in which the water remaining between the tub and the drum is forced to circulate into the drum. Such an apparatus is disclosed in the Korean Patent Laid-Open Publication No. 2006-0114121, laid-open on Nov. 6, 2006, entitled "REMAINING WATER CIRCULATION SYSTEM FOR A DRUM TYPE WASHING MACHINE" and provides background for the instant application. Such an apparatus is configured in a way that when the drum is rotated, washing water that remains between the tub and the drum is drawn up and then falls down into the drum.

Such an apparatus was configured so drat the impact of the falling water on laundry would improve washing performance. However the improvement was limited.

SUMMARY

Embodiments according to the present invention provide a washing machine that includes an auxiliary washing unit and a washing method thereof that improve washing performance by utilizing a rotational force generated when an electric motor which is a power unit for a washing cycle and a rinsing cycle is used to rotate the washing water that causes the laundry to be impacted.

In an embodiment according to the present invention, a washing machine includes an outer tank in which washing water is held, an inner tank that is installed rotatably inside the outer tank, and an auxiliary washing unit that is installed inside the inner tank. In an embodiment, the auxiliary washing unit includes: a supporting member that can rotate integrally with the inner tank, the supporting member having a water channel through which the washing water flows out, after flowing in; and at least one rotor assembly that is installed in the supporting member and projects toward the de of the inner tank and is rotated by a force of the washing water that is passing through the water channel.

In the washing machine, laundry in the inner tank is lifted and then dropped repeatedly by means of the rotor assembly while the inner tank is rotated.

In an embodiment, there are two rotor assemblies installed in the supporting member. The two rotor assemblies are adjacent to each other and rotate in opposite directions relative to each other while the inner tank is rotated.

In an embodiment, the rotor assembly includes a hydro-driven propeller that can be rotated by a driving force generated by a force of action of the washing water, and an impact projection member that is rotated integrally with the hydro-driven propeller and can apply a physical force to the laundry in the inner tank.

In an embodiment, the water channel has a shape that is narrower in diameter toward the center away from the edge of the supporting member.

Embodiments according to the present invention also provide a washing method, which includes: rotating an inner tank; contacting an auxiliary washing unit with washing water by rotation of the inner tank; rotating a rotor assembly of in the auxiliary washing unit in response to a driving force generated while the washing water passes through the auxiliary washing unit, and washing a laundry by rubbing caused by the laundry contacting the rotating rotor assembly.

In embodiments according to the present invention, a rotational force generated when an electric motor, which is a power unit for a washing cycle and a rinsing cycle, is rotated into the washing water is utilized to apply a direct impact to the laundry, thereby improving washing performance by virtue of the effect of rubbing caused by the direct impact.

DETAILED DESCRIPTION

Hereinafter, embodiments according to the present invention will be described in detail with reference to the accompanying drawings.

In the following description, well-known functions or components will not be described in detail to avoid unnecessarily obscuring aspects of the present invention.

Figure 1:
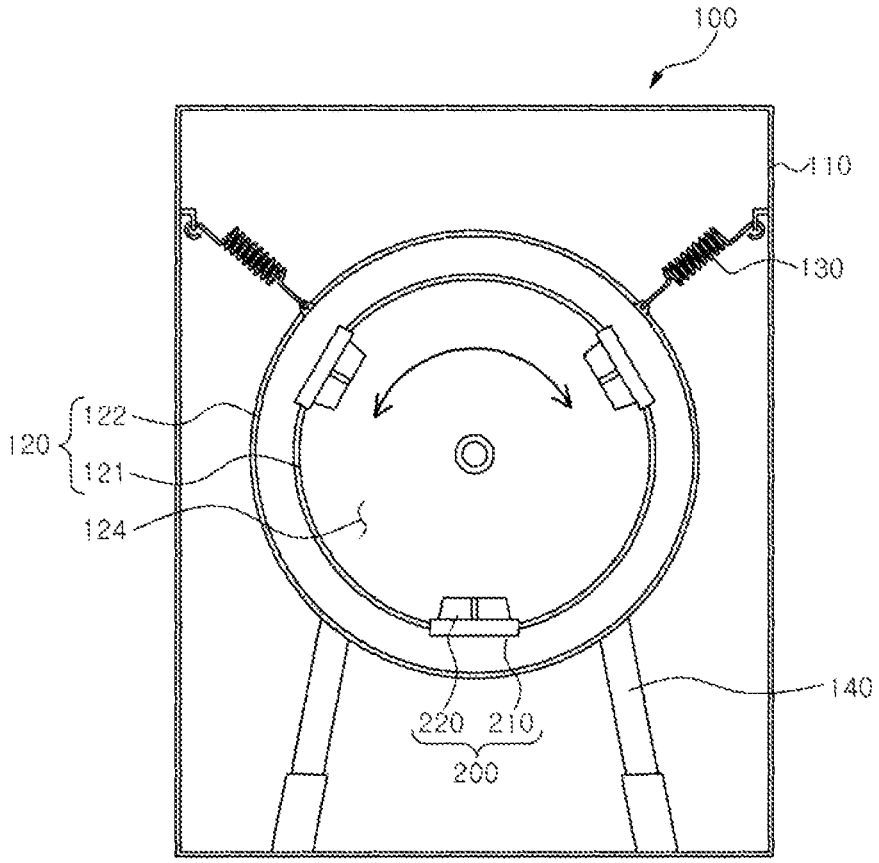
FIG. 1 is a front view of a washing machine in an embodiment according to the present invention.

FIG. 1 is a front view of a washing machine in an embodiment according to the present invention.

Referring to FIG. 1, a washing machine 100 in an embodiment according to the present invention includes a cabinet 110 forming the exterior, a washing body 120 for washing laundry, and an auxiliary washing unit 200 that improves washing performance.

The cabinet 110 is formed in a shape to accommodate and support the washing body 120. For example, the cabinet 110 may have a hexahedral shape. Also, a control panel (not shown) that includes buttons and the like is provided in the front or upper surface of the cabinet 110 so that a user can select a washing function.

In an embodiment, the washing body 120 is disposed inside the cabinet 110 and includes an inner tank 121 that can be rotated by a motor that has a horizontal rotating shaft. In an embodiment, the washing body 120 includes an outer tank 122 that supports the inner tank 121 and can hold water for washing. If the washing machine 100 is a drum type washing machine, then the inner tank 121 may be referred to as a drum, and the outer tank 122 may be referred to as a tub.

As mentioned above, the inner tank 121 can rotate on a rotating shaft, that is parallel with the ground (hereinafter, referred to as "the horizontal direction") on which the cabinet 110 is disposed. The inner tank 121 may have a cylindrical shape with an open end which may be opened and closed selectively by a door (not shown). In addition, a washing space 124 in which the laundry can be washed is provided in the inner tank 121.

The upper portion of the outer tank 122, which supports the inner tank 121, may be fixed elastically to the cabinet 110 by an elastic member 130 such as a spring, and the lower portion of the outer tank 122 may be supported by a fixing member 140. The fixing member 140 may be a dampener which can reduce vibration caused by rotation of the inner tank 121.

In an embodiment, the auxiliary washing unit 200 includes a supporting member 210 which rotates integrally with the inner tank 121, and the supporting member has a water channel formed therein through which washing water flows out, after flowing in. Also, in an embodiment, the auxiliary washing unit 200 includes at least one rotor assembly 220, which is installed in the supporting member 210 so that it projects toward the inside of the inner tank 121 and is rotated by the force of the washing water passing through the water channel that is in the supporting member 210 in order to impact the laundry.

Figure 2:
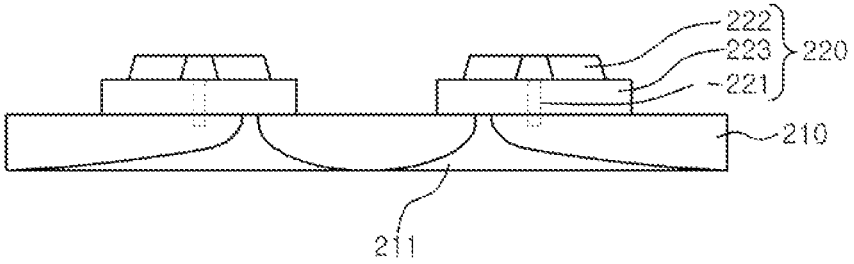
FIG. 2 is a side view of an auxiliary washing unit in a washing machine in an embodiment according to the present invention.
Figure 3:
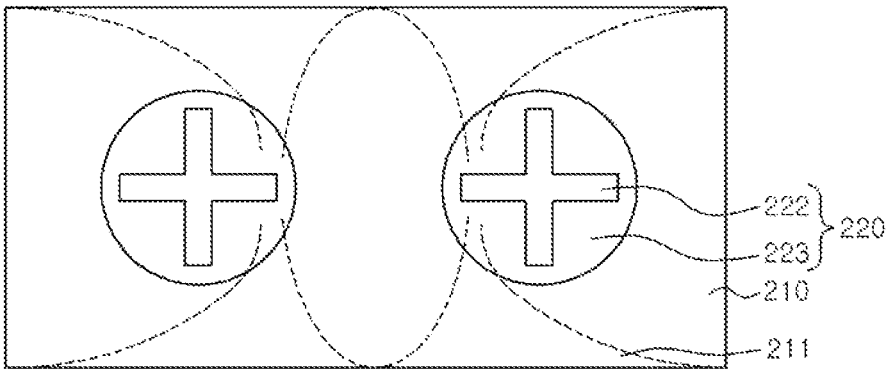
FIG. 3 is a top view of an auxiliary washing unit in a washing machine in an embodiment according to the present invention.
Figure 4:
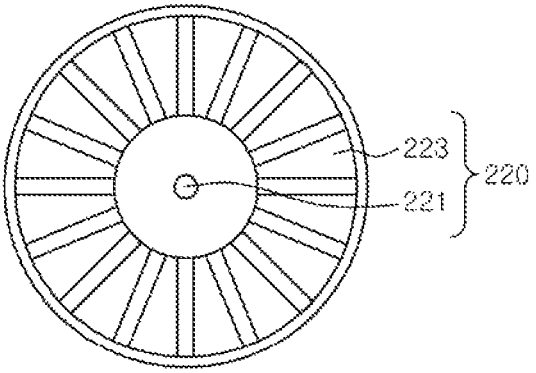
FIG. 4 is a rear view of a rotor assembly of an auxiliary washing unit in a washing machine in an embodiment according to the present invention.

FIG. 2 is a side view of an auxiliary washing unit that can be used in a washing machine in an embodiment according to the present invention. FIG. 3 is a top view of an auxiliary washing unit that can be used in a washing machine in an embodiment according to the present invention. FIG. 4 is a rear view of a rotor assembly of an auxiliary washing unit that can be used in a washing machine in an embodiment according to the present invention.

Referring to FIGS. 2 through 4, in an embodiment according to the present invention, the supporting member 210 of the auxiliary washing unit 200 includes a water channel 211 that allows washing water to flow from the outer tank 122 by rotational force while the inner tank 121 is rotated. The washing water passing through the water channel can transfer the rotational force of the inner tank 121 to the rotor assembly 220. In FIG. 3, the water channel 211 is formed inside the supporting member 210, which is shown as a dotted line.

The rotor assembly 220 includes a rotating shaft 221 which is coupled rotatably to the supporting member 210. In addition, the rotor assembly 220 further includes a hydro-driven propeller 223 shaped like an impeller and that can be rotated by a driving force caused by the force of the washing water. Further, the rotor assembly 220 is rotated together with the hydro-driven propeller 223 in an integrally coupled state (e.g., the rotor assembly 220 is coupled to the propeller 223, such that rotation of the propeller causes the rotor assembly to rotate). The rotor assembly 220 further includes an impact projection member 222 that jointly rotates with the propeller 223 and can apply physical force to the laundry that is in the washing space 124 of the inner tank 121. The impact projection member 222 may be formed in any of a variety of shapes, for example, across shape, a linear shape, etc.

Furthermore, in an embodiment, the water channel 211 has a shape that is narrower toward the center and away from the edge of the supporting member 210. Such a structure for the water channel 211 increases the speed of the washing water as it flows toward the center and away from the edge of the supporting member 210.

Also, as the inner tank 121 repeatedly rotates forward and backward during a washing cycle and during a rinsing cycle, washing water flows in the forward direction in the supporting member 210 while the inner tank 121 is rotating in the forward direction, and in the reverse direction while the inner tank 121 is rotating in the reverse direction.

Moreover, in an embodiment, multiple (e.g., two) rotor assemblies 220 may be formed on the supporting member 210. The two rotor assemblies 220 are adjacent to each other and can rotate in different (e.g., opposite) directions relative to each other while the inner tank 121 is rotated. In such an embodiment, two water channels 211 may be formed symmetrically, e.g., one to the left and one to the right of the virtual center line between the two rotor assemblies 220.

Figure 7:
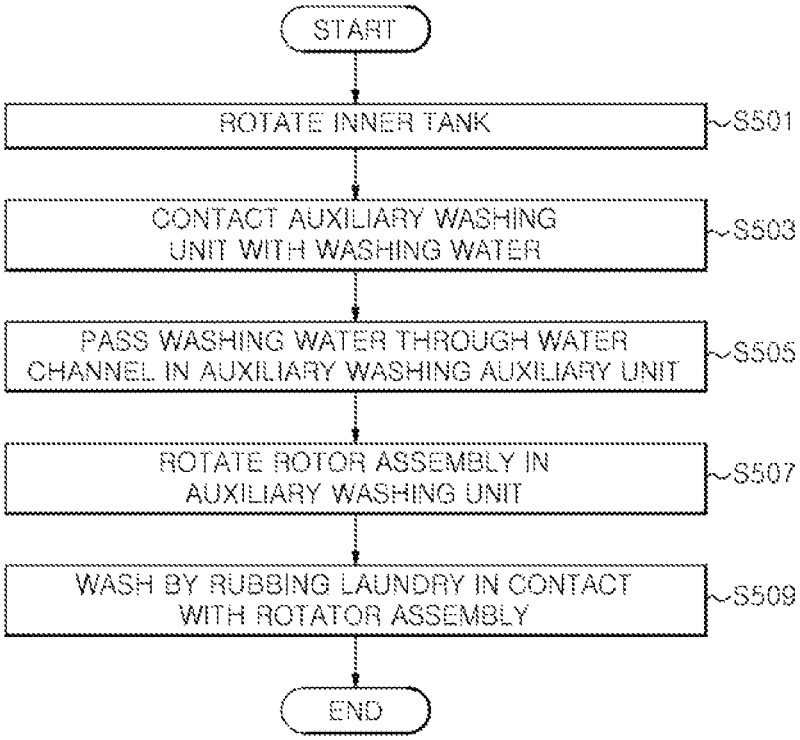
FIG. 7 is a flowchart illustrating a washing method in a washing machine with an auxiliary washing unit in an embodiment according to the present invention.

FIG. 7 is a flowchart illustrating a washing method using a washing machine with an washing auxiliary unit in an embodiment according to the present invention.

As described in FIG. 7, the washing method in an embodiment according to the present invention includes rotating the inner tank at block S501.

The washing method further includes contacting the auxiliary washing unit with the washing water while the inner tank is rotated (block S503).

Next, the washing method further includes passing the washing water through the water channel formed in the washing auxiliary unit (block S505).

Also, the washing method further includes rotating the rotor assembly in the auxiliary washing unit by a driving force induced by the washing water passing through the water channel (block S507).

Finally, the washing method further includes washing the laundry by contacting and rubbing the laundry against the rotor assembly (block S509).

Hereinafter, operation of the washing machine in an embodiment according to the present invention will be described, with reference to FIG. 7.

First, during a washing cycle or a rinsing cycle, washing water flows into the outer tank 122, and the inner tank 121 is rotated by a motor that has a rotational shaft that is disposed horizontally to the ground, at block S501.

Laundry in the washing space 124 is lifted and dropped repeatedly by the rotor assembly 220 of the auxiliary washing unit 200 while the inner tank 121 is rotated. That is, the rotor assembly 220 performs a function similar to a lifter in a drum type washing machine.

When the inner tank 121 is rotated as described above, the auxiliary washing unit 200 is contacted by the washing water in the outer tank 122, at block S503, and the washing water the outer tank 122 flows into the water channel 211 in the supporting member 210 of the auxiliary washing unit 200 due to the rotational force of the inner tank 121. In an embodiment, the water channel 211 has a shape that is narrower toward the center and away from the edge of the supporting member 210, and thus when the washing water passes through the washing channel 211, its speed increases as it flows toward the center and away from the edge of the supporting member, at block S505.

The washing water passing through the water channel 211 transfers the rotational force of the inner tank 121 to the rotor assembly 220 constituting elements of the auxiliary washing unit 200. That is, the hydro-driven propeller 223 is rotated by the driving force caused by the force of the washing water, and the impact projection member 222 formed integrally with the hydro-driven propeller 223 is rotated on the rotating shaft 221, at block S507. Accordingly, laundry in the washing space 124 of the inner tank 121 is impacted by the impact projection member 222. By virtue of the effect on washing due to rubbing caused by that impact, the washing performance for the laundry is improved, at block S509.

Figure 5:
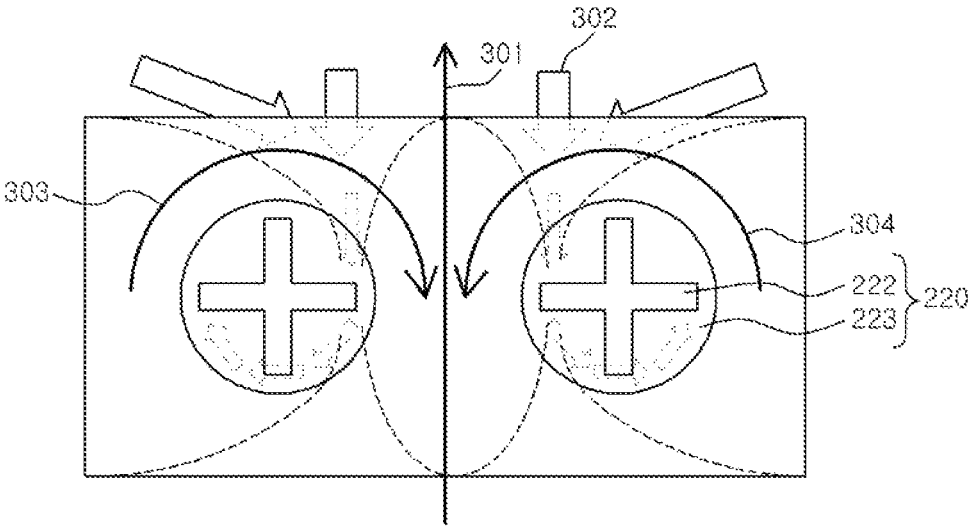
FIG. 5 is a top view of an auxiliary washing unit in a washing machine in an embodiment according to the present invention, showing a path into a water channel taken by washing water stored in an outer tank.

For example, as shown in FIG. 5, when the auxiliary washing unit 200 proceeds in the direction of the arrow 301 due to rotation of the inner tank 121, the washing water flows into the water channel 211 in the supporting member 210 in the direction of the arrow 302, which rotates the rotator assembly 220.

In an embodiment, the water channel 211 is formed symmetrically to the left and right relative to the virtual centerline between the two rotor assemblies 220 that are adjacent to each other. In this case, when the inner tank 121 is rotated, the two rotor assemblies 220 will rotate in the opposite directions 303, 304 relative to each other. This configuration is provided so the auxiliary washing unit 200 will be durable. For example, laundry that is between the two rotor assemblies 220 and is impacted by the impact projection member 222 of the rotor assembly 220 is forced to move in one direction, and thus the load imposed on the rotor assembly 220 is maintained with an acceptable level.

Figure 6:
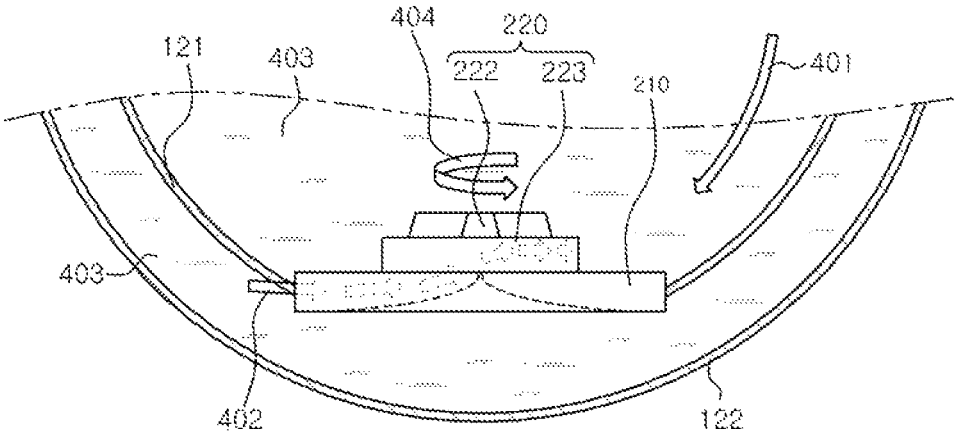
FIG. 6 is a front view of a washing machine including an auxiliary washing unit in an embodiment according to the present invention, showing a path into a water channel taken by washing water stored in the outer tank of the auxiliary washing unit.

Also, as shown in FIG. 6, when the inner tank 121 is rotated in the direction of the arrow 401, the washing water 403 flows in the direction of the arrow 402 into the water channel 211 in the supporting member 210. Consequently, the rotor assembly 220 is forced to rotate in the direction of the arrow 404, and the laundry is impacted by the impact projection member 222 of the rotor assembly 220.

As described above, in an embodiment according to the present invention, when the inner tank 121 is rotated during the washing cycle or the rinsing cycle, the laundry experiences impacts from the impact projection member 222 of the rotor assembly 220 constituting auxiliary washing unit 200, thereby improving washing performance by virtue of the rubbing caused by such impacts.

As set forth above, while the present invention has been described in connection with specific embodiments of a washing machine, the embodiments are only examples and the present invention is not limited thereto. It should be construed that the present invention has the widest range in compliance with the basic ideas disclosed in this disclosure. Although it is possible for those skilled in the art to combine and substitute for the disclosed embodiments to embody other washing machine types that may not be specifically disclosed in this disclosure, they do not depart from the spirit and scope of the present invention. In addition, it will be apparent to those skilled in the art that various modifications and changes may be made with respect to the disclosed embodiments based on the disclosure and those changes and modifications also fall within the spirit and scope of the present invention.

Embodiments according to the invention are thus described. While the present disclosure has been described in particular embodiments, it should be appreciated that the invention should not be construed as limited by such embodiments, but rather construed according to the below claims.

What is claimed is:

1. A washing machine, comprising:

an outer tank in which water can be held;

an inner tank which is installed rotatably inside the outer tank; and an auxiliary washing unit which is installed inside the inner tank, wherein the auxiliary washing unit comprises:

a supporting member which is configured to rotate integrally with the inner tank, the supporting member having a water channel, formed inside the supporting member, through which the water flows out, after flowing in; and at least one rotor assembly which is installed on the supporting member to protrude from the supporting member toward the inside of the inner tank and is rotated by the force of action of the water that is flowing out from the supporting member via the water channel.

2. The washing machine of claim 1, wherein laundry in the inner tank is lifted and then dropped repeatedly by means of the rotor assembly while the inner tank is rotated.

3. The washing machine of claim 1, wherein the at least one rotor assembly comprises two rotor assemblies, wherein the two rotor assemblies are adjacent to each other and rotate in opposite directions relative to each other while the inner tank is rotated.

4. The washing machine of claim 1, wherein the at least one rotor assembly comprises:

a hydro-driven propeller that is configured to be rotated by a driving force generated by a force of action of the water; and an impact projection member that is rotated integrally with the hydro-driven propeller and is configured to apply a force to the laundry in the inner tank.

5. The washing machine of claim 4, wherein the water channel has a shape that is narrower toward the center and away from the edge of the supporting member.

6. A washing method for use with the washing machine of claim 1, comprising:

rotating the inner tank of the washing machine, wherein the rotation of the inner tank causes water to contact the auxiliary washing unit; and rotating the at least one rotor assembly in the auxiliary washing unit by the force of action of the water that is flowing out from the supporting member via the auxiliary washing unit;

wherein laundry is washed by the laundry contacting with the rotating rotor assembly.

7. The washing method of claim 6, wherein laundry in the inner tank is lifted and then dropped repeatedly by means of the rotor assembly while the inner tank is rotated.

8. The washing method of claim 6, wherein at least one rotor assembly comprises two rotor assemblies, wherein the two rotor assemblies are adjacent to each other and rotate in opposite directions relative to each other while the inner tank is rotated.

9. The washing method of claim 6, wherein the at least one rotor assembly comprises:

a hydro-driven propeller that is configured to be rotated by a driving force generated by a force of action of the washing water; and an impact projection member that is rotated integrally with the hydro-driven propeller and is configured to apply a force to the laundry in the inner tank.

10. The washing method of claim 9, wherein the water channel has a shape that is narrower toward the center and away from the edge of the supporting member.

11. An auxiliary washing unit for a washing machine, wherein the auxiliary washing unit comprises:

a supporting member which is configured to rotate integrally with the washing machine's inner tank, the supporting member having a water channel, formed inside the supporting member, through which water flows out, after flowing in; and at least one rotor assembly which is installed on the supporting member to protrude from the supporting member toward the inside of the inner tank and is rotated by the force of action of the water that is flowing out from the supporting member via the water channel.

12. The auxiliary washing unit of claim 11, wherein the at least one rotor assembly comprises two rotor assemblies, wherein the two rotor assemblies are adjacent to each other and rotate in opposite directions relative to each other while the inner tank is rotated.

13. The auxiliary washing unit of claim 11, wherein the at least one rotor assembly comprises:

a hydro-driven propeller that is configured to be rotated by a driving force generated by a force of action of the washing water; and an impact projection member that is rotated integrally with the hydro-driven propeller and is configured to apply a force to the laundry in the inner tank.

14. The auxiliary washing unit of claim 13, wherein the water channel has a shape that is narrower toward the center and away from the edge of the supporting member.

15. The auxiliary washing unit of claim 11, wherein the at least one rotor assembly comprises an impact projection member, wherein laundry in the washing machine's inner tank is impacted by the impact projection member.

16. The washing machine of claim 1, wherein the at least one rotor assembly comprises an impact projection member, wherein laundry in the inner tank is impacted by the impact projection member.

* * * * *